US005478688A

United States Patent [19]

Spiewak et al.

[11] Patent Number: 5,478,688

[45] Date of Patent: Dec. 26, 1995

[54] LIQUID DEVELOPER COMPOSITIONS WITH CHARGE ADJUVANTS OF A COPOLYMER OF AN ALKY ACRYLAMIDOGLYCOLATE ALKYL ETHER AND AN ALKENYLESTER

[75] Inventors: John W. Spiewak, Webster; James R. Larson, Fairport; Frank J. Bonsignore, Rochester, all of N.Y.

[73] Assignee: Xerox Corporation, Stamford, Conn.

[21] Appl. No.: 332,151

[22] Filed: Oct. 31, 1994

[51] Int. Cl.[6] ..... G03G 8/135

[52] U.S. Cl. ..... 430/115; 430/114

[58] Field of Search ..... 430/115, 114

[56] References Cited

U.S. PATENT DOCUMENTS

| | | | |
|---|---|---|---|
| 4,707,429 | 11/1987 | Trout | 430/115 |
| 4,988,597 | 1/1991 | Spiewak et al. | 430/62 |
| 5,019,477 | 5/1991 | Felder | 430/115 |
| 5,026,621 | 6/1991 | Tsubuke et al. | 430/109 |
| 5,030,535 | 7/1991 | Drappel et al. | 430/116 |
| 5,035,972 | 7/1991 | El-Sayed et al. | 430/114 |
| 5,235,016 | 8/1993 | Vafa et al. | 526/304 |
| 5,244,762 | 9/1993 | Spiewak et al. | 430/58 |

*Primary Examiner*—Christopher D. Rodee
*Attorney, Agent, or Firm*—E. O. Palazzo

[57] ABSTRACT

A positively charged liquid developer comprised of liquid, thermoplastic resin particles, optional pigment, a charge director, and an insoluble charge adjuvant comprised of a copolymer of an alkyl acrylamidoglycolate alkyl ether and an alkenylester, and wherein the charge adjuvant is associated with or combined with said resin and said optional pigment, and which charge adjuvant is of the formula

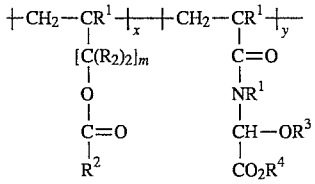

wherein $R^1$ is hydrogen or alkyl of 1 to 20 carbons; $R^2$ is H, alkyl of 1 to 20, aryl of 6 to 20 carbons, and aryl alkyl of 7 to 35 carbons; m is from 0 to about 10; and wherein the alkyl and aryl groups optionally contain heteroatoms of F, Cl, O, S, N, Si, and P; $R^3$ and $R^4$ are alkyl; and x and y represent the number of segments.

27 Claims, No Drawings

LIQUID DEVELOPER COMPOSITIONS WITH CHARGE ADJUVANTS OF A COPOLYMER OF AN ALKY ACRYLAMIDOGLYCOLATE ALKYL ETHER AND AN ALKENYLESTER

BACKGROUND OF THE INVENTION

This invention is generally directed to liquid developer compositions and, more specifically, the present invention relates to a liquid developer containing alkyl acrylamidoglycotate alkyl ether copolymers, and which copolymers are functioning as charge adjuvants. More specifically, the present invention relates to positively charged liquid developers comprised of a suitable carrier liquid and particles containing a charge adjuvant comprised of (MAGME) copolymers of an alkyl acrylamidoglycolate alkyl ether, such as methyl acrylamidoglycolate methyl ether-co-vinyl acetate, and the like. The developers of the present invention can be selected for a number of known imaging systems, such as xerographic imaging and printing processes, wherein latent images are rendered visible with the liquid developers illustrated herein. The image quality, solid area coverage and resolution for developed images usually require, for example, sufficient toner particle electrophoretic mobility. The mobility for effective image development is primarily dependent on the imaging system used, and this electrophoretic mobility is directly proportional to the charge on the toner particles and inversely proportional to the viscosity of the liquid developer fluid. For example, an about 10 to 30 percent change in fluid viscosity caused for instance by an about 5° to 15° C. decrease in temperature could result in a decrease in image quality, poor, or unacceptable image development and undesirable background development, for example, because of a 5 percent to 23 percent decrease in electrophoretic mobility. Insufficient particle charge can also result in poor, or no transfer of the toner to paper or other substrates. Poor transfer, for example, can result in poor solid area coverage if insufficient toner is transferred to the final substrate and can also result in image defects such as smearing and hollowed fine features. To overcome or minimize such problems, the liquid toners of the present invention were arrived at after substantial research efforts, and which toners result in, for example, sufficient particle charge, generally corresponding to an electrophoretic mobility which is derived from the zeta potential obtained by ESA greater than 220 millivolts for excellent transfer and maintaining the mobility within the desired range of the particular imaging system employed. Advantages associated with the present invention include improvements in the desired positive charge on the developer particles; in some instances the improvement, as measured by ESA, is from 199 millivolts without the methyl acrylamidoglycolate methyl ether copolymer additives of this invention to 249 millivolts when the methyl acrylamidoglycolate methyl ether copolymer charge adjuvants of the present invention are selected. The greater toner charge results in, for example, improved image development and higher quality images, such as higher resolutions with less background deposits.

A latent electrostatic image can be developed with toner particles dispersed in an insulating nonpolar liquid. Such dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy.

Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid, which generally has a high volume resistivity in excess of 109 ohm-centimeters, a low dielectric constant, for example below 3.0, and a low vapor pressure. Generally, the toner particles are less than 10 μm (microns) average by area size as measured with the Horiba 700 Particle Sizer.

Since the formation of proper images depends primarily on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director can be of importance in controlling the charging properties of the toner to enable excellent quality images.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid-repelling and solvent-soluble properties.

In U.S. Pat. No. 4,707,429 there are illustrated, for example, liquid developers with an aluminum stearate charge adjuvant. Liquid developers with charge directors are illustrated in U.S. Pat. No. 5,045,425. Also, stain elimination in consecutive colored liquid toners is illustrated in U.S. Pat. No. 5,069,995.

In U.S. Pat. No. 5,306,591 and U.S. Pat. No. 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively. In copending patent application U.S. Ser. No. 065,414, the disclosure of which is totally incorporated herein by reference, there is illustrated a liquid developer comprised of thermoplastic resin particles, and a charge director comprised of an ammonium AB diblock copolymer of the formula

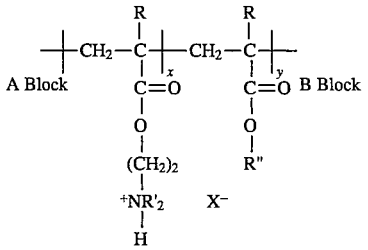

wherein $X^-$ is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 100 to 20. The charge adjuvants and other appropriate components of these copending applications may be selected for the liquid toners of the present invention.

SUMMARY OF THE INVENTION

Examples of objects of the present invention include:

It is an object of the present invention to provide a liquid developer with many of the advantages illustrated herein.

Another object of the present invention resides in the provision of a liquid developer capable of high particle charging.

Another object of the invention is to provide positively charged liquid developers wherein there are selected as charge adjuvants, or charge additives copolymers of methyl acrylamidoglycolate methyl ether.

It is a further object of the invention to provide positively charged liquid developers wherein there are selected as charge adjuvants, or charge additives copolymers of methyl acrylamidoglycolate methyl ether such as poly(methyl acrylamidoglycolate methyl ether-co-vinyl acetate).

It is still a further object of the invention to provide a liquid developer wherein developed image defects, such as smearing, loss of resolution and loss of density, are eliminated, or minimized, and wherein there are selected economical charge directors that permit toners that can be easily transferred from imaging members such as photoreceptor drums.

Also, in another object of the present invention there are provided improved positively charged liquid developers with certain charge directors.

Another object of the present invention resides in the provision of liquid developers with known additives and adjuvants, which adjuvants are comprised of MAGME, methylacrylamidoglycolate methyl ether, radially polymerized with other components like known vinyl monomers.

These and other objects of the present invention can be accomplished in embodiments by the provision of liquid developers with certain charge adjuvants comprised of copolymers of methyl acrylamidoglycolate methyl ether. In embodiments, the present invention is directed to positively charged liquid developers comprised of a toner resin, pigment, and a charge adjuvant comprised of certain copolymers of methyl acrylamidoglycolate methyl ether, and wherein the charge adjuvant copolymer is comprised of from about 1 to about 100 weight percent, and preferably from about 10 to about 50 weight percent of the toner composition.

An example of a general formula that can be utilized to illustrate the charge adjuvant copolymers of the present invention prepared from alkyl acrylamidoglycolate alkyl ethers and alkenyl esters follows

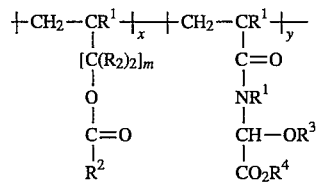

wherein $R^1$ is hydrogen, alkyl of from 1 to about 20 and preferably 6 carbon atoms; $R^2$ is hydrogen, alkyl preferably of 1 to about 20 carbon atoms, aryl preferably of from 6 to about 24 carbon atoms or arylalkyl preferably of 7 to 35 carbon atoms, and preferably 6 to about 20 carbon atoms; m is a number, such as in the range of zero to 10, and wherein alkyl and aryl can contain heteroatoms like F, Cl, O, S, N ,Si, P, and the like; and wherein x and y represent the number of segments, and more specifically, represent $5.67 > x/y > 0.176$.

Examples of typical alkyl acrylamidoglycolate alkyl ether monomers include methyl acrylamidoglycolate methyl ether, butyl acrylamidoglycolate methyl ether, methyl acrylamidoglycolate butyl ether, butyl acrylamidoglycolate butyl ether, methyl acrylamidoglycolate ethyl ether, ethyl acrylamidoglycolate methyl ether, ethyl acrylamidoglycolate ethyl ether, methyl acrylamidoglycolate propyl ether, isopropyl acrylamidoglycolate methyl ether, isopropyl acrylamidoglycolate butyl ether, and the like. Examples of typical alkyl acrylamidoglycolate alkyl ether copolymers include poly(methyl acrylamidoglycolate methyl ether-co-vinyl acetate), poly(methyl acrylamidoglycolate methyl ether-co-vinyl propionate), poly(methyl acrylamidoglycolate methyl ether-co-vinyl butyrate), poly(methyl acrylamidoglycolate methyl ether-co-allyl acetate), poly(methyl acrylamidoglycolate methyl ether-co-allyl propionate), poly(methyl acrylamidoglycolate methyl ether-co-allyl butyrate), poly(methyl acrylamidoglycolate butyl ether-co-vinyl acetate), poly(methyl acrylamidoglycolate butyl ether-co-allyl acetate), poly(butyl acrylamidoglycolate methyl ether-co-vinyl acetate), poly(butyl acrylamidoglycolate methyl ether-co-allyl acetate), poly(butyl acrylamidoglycolate butyl ether-co-vinyl acetate), poly(butyl acrylamidoglycolate butyl ether-co-allyl acetate), and the like.

A copolymer molecular weight (Mn) range of from about 1,000 to about 1,000,000 can generally be obtained using optimum reaction conditions with the appropriate quantities of radical initiator, alkyl acrylamidoglycolate alkyl ether monomers and alkenyl ester monomers. The mole ratio of the comonomers can vary from 85:15 to 15:85.

In embodiments, the present invention is directed to positively charged liquid developers comprised of a toner resin, pigment, and a charge adjuvant.

Embodiments of the present invention include a liquid developer comprised of thermoplastic resin particles, and a charge adjuvant comprised of copolymers of an alkyl acrylamidoglycolate alkyl ether and an alkenyl ester; a liquid developer, comprised of a liquid component, thermoplastic resin; a charge adjuvant comprised of certain copolymers of alkyl acrylamidoglycolate alkyl ether and an alkenyl ester as illustrated herein; and a liquid electrostatographic developer comprised of (A) a nonpolar liquid having viscosity of from about 0.5 to about 20 centipoise and resistivity about equal to or greater than $5\times10^9$ ohm-cm with a preferred range of from about $10^{10}$ to about $10^{14}$ ohm-cm; (B) thermoplastic resin particles with an average volume particle diameter of from about 0.1 to about 30 microns; (C) a charge adjuvant comprised of certain copolymers of alkyl acrylamidoglycolate alkyl ether as illustrated herein, and wherein the charge adjuvant is associated with or combined, preferably permanently, with the resin and pigment; and (D) a charge director compound.

In embodiments, the present invention relates to a liquid developer comprised of thermoplastic resin particles, and a charge adjuvant comprised of a copolymer of an alkyl acrylamidoglycolate alkyl ether and an alkenyl ester as illustrated herein.

A positively charged liquid developer of the present invention having a charge sufficient to result in a particle electrophoretic mobility corresponding to a zeta potential greater than 220 millivolts as determined by the Matec ESA apparatus is, for example, comprised of a liquid component, thermoplastic resin, and a charge adjuvant comprised of copolymers of alkyl acrylamidoglycolate methyl ether and the like, which adjuvants are present in various effective amounts, such as for example from about 1 to about 100 weight percent of the liquid toner solids, which include resin, optional pigment and charge adjuvant, and a charge director; and a liquid electrostatographic developer comprised of (A) a liquid having viscosity of from about 0.5 to about 20 centipoise and resistivity greater than $5\times10^9$; (B) thermoplastic resin particles with an average volume particle diameter of from about 0.1 to about 30 microns; (C) a charge adjuvant comprised of certain copolymers of alkyl acrylamidoglycolate methyl ether as illustrated herein; and (D) a charge director.

In embodiments, it is important that the toner particle be comprised of the optional thermoplastic resin, the charge adjuvant, and the optional pigment. Therefore, it is important that the thermoplastic resin and the charge adjuvant be sufficiently compatible that these do not form separate particles, and that the charge adjuvant be insoluble in the hydrocarbon to the extent that no more than 0.1 weight percent be soluble in the nonpolar liquid.

The charge director can be selected for the liquid developers in various effective amounts, such as for example in embodiments from about 5 to 1,000 milligrams of charge director per gram of toner solids, and preferably 10 to 100 milligrams/gram. Developer solids include toner resin, optional pigment, and charge adjuvant. Without pigment, the developer may be selected for the generation of a resist, a printing plate, and the like.

Examples of effective charge directors for positive liquid toner particles include anionic glyceride such as EMPHOS D70-30C® and EMPHOS F27-85®, two products available from Witco Corporation, New York, N.Y., which are sodium salts of phosphated mono- and diglycerides with saturated and unsaturated substituents, respectively; EMPHOS PS-900® available from Witco Corporation, New York, N.Y., which is one of a comprehensive anionic series of complex organic phosphate esters, lecithin, Neutral Barium Petronate, Calcium Petronate, Neutral Calcium Petronate, oil soluble petroleum sulfonates, Witco Corporation, New York, N.Y., and metallic soap charge directors, such as aluminum tristearate, aluminum distearate, barium, calcium, lead, and zinc stearates; cobalt, manganese, lead, and zinc lineolates; aluminum, calcium, and cobalt octoates; calcium and cobalt oleates; zinc palmitate; calcium, cobalt, manganese, lead, and zinc resinates, and hydroxy bis(3,5-di-tert-butyl salicylic) aluminate monohydrate, a mixture of hydroxy bis(3,5-di-tert-butyl salicylic) aluminate monohydrate and EMPHOS PS-900®, and the like. Other effective positive charge directors include AB diblock copolymers of 2-ethylhexylmethacrylate-co-methacrylic acid calcium and ammonium salts as illustrated in U.S. Pat. No. 5,130,221, the disclosure of which is totally incorporated herein by reference.

Examples of liquid carriers, or nonpolar liquids selected for the developers of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm-cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto-ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR® M has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr in embodiments. The amount of liquid carrier or nonpolar liquid is 75 to 99.9 weight percent and preferably between 95 and 99 weight percent.

Although in embodiments the ISOPAR® series liquids are the preferred nonpolar liquids for use as dispersants in the liquid developers of the present invention, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 75 percent to about 99.9 percent, and preferably from about 95 to about 99 percent by weight of the total developer dispersion. The total solids components content of the developer is, for example, 0.1 to 25 percent by weight, preferably 1.0 to 5 percent.

Typical suitable thermoplastic toner resin can be selected for the liquid developers of the present invention in effective amounts of, for example, in the range of about 99 percent to about 40 percent, and preferably about 95 percent to about 70 percent of developer solids comprised of thermoplastic resin, pigment, charge adjuvant, and in embodiments other optional components, such as magnetic materials like magnetites, that may comprise the developer. Generally, developer solids include the thermoplastic resin, optional pigment and charge adjuvant. Examples of thermoplastic resins include ethylene vinyl acetate (EVA) copolymers, (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid (optional but preferred), and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an α-β-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

The liquid developer of the present invention preferably contains a colorant dispersed in the resin particles. Colorants, such as pigments or dyes like black, cyan, magenta, yellow, red, blue, green, brown, and mixtures such as wherein any one colorant may comprise from 0.1 to 99.9 weight percent of the colorant mixture with another or other colorants comprising the remaining percentage thereof are preferably present to render the latent image visible.

The colorant may be present in the resin particles in an effective amount of, for example, from about 0.1 to about 60 percent, and preferably from about 10 to about 30 percent by weight based on the total weight of solids contained in the developer. The amount of colorant used may vary depending on the use of the developer, for instance if the toned image is to be used to form a chemical resist image no pigment is necessary. Examples of pigments which may be selected include carbon blacks available from, for example, Cabot Corporation (Boston, Mass.), such as MONARCH 1300®, REGAL 330® and BLACK PEARLS®, and color pigments like FANAL PINK™, PV FAST BLUE™, and Paliotol Yellow D1155; pigments as illustrated in copending patent application U.S. Pat. No. 5,223,368, the disclosure of which is totally incorporated herein by reference; and the following list of examples.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901 F | BASF | Blue 15:2 |
| HELIOGEN ® BLUE TBD 701 0 | BASF | Blue:3 |
| HELIOGEN ® BLUE K 7090 | BASF | Blue 15:3 |
| HELIOGEN ® BLUE L 7101 F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |

-continued

| PIGMENT BRAND NAME | MANU-FACTURER | COLOR |
|---|---|---|
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field and the measurement of sound described in Oja et al. U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. No. 5,066,821, U.S. Pat. No. 5,034,299, and U.S. Pat. No. 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, the prior art selects charge adjuvants that are added to the toner particles. For example, adjuvants, such as metallic soaps, like aluminum or magnesium stearate or octoate, fine particle size oxides, such as oxides of silica, alumina, titania, and the like, para-toluenesulfonic acid and polyphosphoric acid, may be added. Negative charge adjuvants increase the negative charge of the toner particle, while the positive charge adjuvants increase the positive charge of the toner particles. With the invention of the present application, the adjuvants or charge additive can be copolymers of methyl acrylamidoglycolate methyl ether. The adjuvants can be added to the liquid toner particles in an amount of from about 0.1 percent to about 20 percent of the total developer solids of toner resin, pigment, and charge adjuvant, and preferably from about 1 percent to about 10 percent of the total weight of solids contained in the developer. When the charge adjuvants of the present invention are employed a positively charged liquid developer is obtained having a charge sufficient to result in a particle mobility, which corresponds to a zeta potential of greater than 220 millivolts as measured with the Matec ESA apparatus.

The liquid electrostatic developer of the present invention can be prepared by a variety of known processes, such as, for example, mixing, in a nonpolar liquid with the thermoplastic resin, charge additive, and optional colorant in a manner that the resulting mixture contains about 15 to about 30 percent by weight of solids, where solids include the resin in an amount range of from 0 to about 99 percent, preferably from about 40 percent to about 90 percent of the solids, pigment in the amount range of 0 to 60 percent, preferably from about 5 to about 40 percent of the solids, and charge adjuvant in the amount range of from about 1 to about 100 percent, preferably from about 10 to about 50 percent, of the solids; heating the mixture to a temperature of from about 70° C. to about 1301° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge director compound to the dispersion; and diluting the dispersion to 1 percent to 2 percent solids.

In the initial mixture, the resin, colorant and charge adjuvant may be added separately to an appropriate vessel, which can vary in size from 50 milliliters to 1,000 liters, such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate grinding media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene glycol, in a jacket surrounding the the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only and that the invention is not intended to be limited to the materials, conditions, process parameters, and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −38 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential, which is directly proportional to toner charge and is independent of particle size. Particle size was measured by the Horiba CAPA-500 and 700 centrifugal automatic particle analyzers manufactured by Horiba Instruments, Inc., Irvine, Calif.

EXAMPLE I

Positive Charge Adjuvant Preparation 1:

Methyl Acrylamidoglycolate Methyl Ether/Vinyl Acetate Predominantly Block Copolymer [SP$^2$-115-66-1]:

To a 12 liter 3-neck round bottom flask were added 500 grams (2.89 mole) of methyl acrylamidoglycolate methyl ether (available from American Cyanamide Company under the trademark MAGME™), 248.3 grams (2.88 mole) of vinyl acetate, and 6,008 grams of methanol solvent. The aforementioned comonomer molar mix in this Example was essentially 50:50. The flask was equipped with a water condenser, an Argon inlet and an Argon outlet to a bubbler to ensure that a positive Argon flow was maintained in the reaction vessel throughout the polymerization period. The resulting mixture was mechanically stirred and sparged with Argon at ambient temperature for 2 hours to dissolve the monomers and displace oxygen. To the resulting solution were added 7.476 grams (0.0455 mole) of azobisisobutyrylnitrile initiator, and the stirred solution was warmed to and maintained at reflux (65° C.) for 24 hours by means of a hot water bath. The polymer solution was next rotoevaporated to dryness leaving the solid polymer, which after vacuum oven drying for 24 hours at 40° C. at about 1 millimeters Hg amounted to 700 grams (93.5 percent of theory). This polymer was used without further purification as a positive charge adjuvant in the Liquid Toner 3 prepared in Example VI.

MAGME™ is described in American Cyanamid Company product brochure 4-211-3K (10/86) as a multifunctional acrylic monomer copolymerizable with various other vinyl type monomers including the vinyl monomers employed herein in Examples I and II. The reactivity ratio is provided in this product brochure for the solution copolymerization of MAGME™ with vinyl acetate at 65° C. in toluene initiated with azobisvaleronitrile, a radical initiator very similar to the azobisisobutyrylnitrile radical initiator used herein. For MAGME™ and vinyl acetate, the reactivity ratios were found to be 38.2+ or −3.2 and 0.10+ or −0.03, respectively. The MAGME™ monomer prefers to enter the growing polymer chain before the vinyl acetate monomer thereby giving a blocky structure to the resulting copolymer. Free radical copolymerizations having large reactivity ratio differences between the two monomers, such as found for MAGME™ and vinyl acetate, not only tend to provide blocky copolymer structures, but in this Example with vinyl acetate as the comonomer, also provide some vinyl acetate homopolymer because of the tendency of the radical terminated vinyl acetate polymer to chain transfer with solvent when most of the vinyl acetate monomer has already been copolymerized late in the polymerization time scheme. It is believed that the polymer product composition in Example I is a two component polymer mixture predominated by a copolymer that is substantially a block copolymer of MAGME™ and vinyl acetate and in much lesser amounts a homopolymer of poly(vinyl acetate). The above reactivity ratios predict that when the mole percent of MAGME monomer in the comonomer mix with vinyl acetate monomer is 20 mole percent, the mole percent of MAGME™ found in the copolymer at low monomer conversion is about 90 mole percent (Product brochure 4-211-3K) indicating a strong preference for the initial incorporation of MAGME™ monomer, rather than vinyl acetate monomer, into the growing polymer chain. This MAGME™ incorporation preference increases with increasing mole percent of MAGME™ in the comonomer mix, such that at 50 mole percent of MAGME™ monomer in the comonomer mix with vinyl acetate monomer (as in this Example), the reactivity ratio predicts about 96 mole percent of MAGME™ in the copolymer at low monomer conversion. The bulk of the remainder of vinyl acetate monomer forms a vinyl acetate block (initiated by the end of the MAGME™ radical polymer chain) later in the polymerization after the bulk of MAGME™ monomer has already been polymerized. When nearly all the vinyl acetate monomer has been copolymerized (very low vinyl acetate monomer concentration remaining) onto the end of the MAGME™ block, some vinyl acetate homopolymer begins to form as a result of chain transfer of the poly (vinyl acetate) radical chain end with solvent.

The chemical structure for MAGME™ monomer and the vinyl polymerized repeat unit are illustrated as follows.

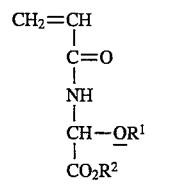

MAGME
Monomer
when $R^1 = R^2 = CH_3$

-continued

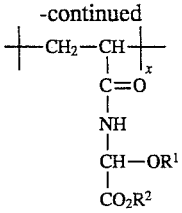

MAGME
Repeat Unit
when $R^1 = R^2 = CH_3$ $R^1$ and $R^2$ are independently selected from lower aliphatic groups containing from 1 to 10 carbon atoms and preferably 1 to 4 carbon atoms. Typical alkyl acrylamidoglycolate alkyl ether monomers include: methyl acrylamidoglycolate methyl ether, butyl acrylamidoglycolate methyl ether, methyl acrylamidoglycolate butyl ether, butyl acrylamidoglycotate butyl ether, methyl acrylamidoglycolate ethyl ether, ethyl acrylamidoglycolate methyl ether, ethyl acrylamidoglycolate ethyl ether, methyl acrylamidoglycolate propyl ether, isopropyl acrylamidoglycolate methyl ether and isopropyl acrylamidoglycolate butyl ether.

EXAMPLE II

Positive Charge Adjuvant Preparation 2

Methyl Acrylamidoglycolate Methyl Ether/Acrylonitrile Random Copolymer [$SP^2$-113-6-1]:

To a 5 liter 3-neck round bottom flask were added 233.6 grams (1.35 mole) of methyl acrylamidoglycolate methyl ether (MAGME™), 71.6 grams (1.35 mole) of acrylonitrile, and 246.8 grams of methanol solvent. The comonomer molar mix in this Example was 50:50. The flask was equipped with a water condenser, an Argon inlet and an Argon outlet to a bubbler to ensure that a positive Argon flow was maintained in the reaction vessel throughout the polymerization period. The mixture was mechanically stirred and sparged with Argon at ambient temperature for 2 hours to dissolve the monomers and displace oxygen. To the resulting solution were added 3.05 grams (0.0186 mole) of azobisisobutyrylnitrile initiator, and the stirred solution was warmed to and maintained at 60° C. for 24 hours by means of a hot water bath. The polymer solution was next roto-evaporated to dryness leaving the solid polymer which after vacuum oven drying for 24 hours at 40° C. at about 1 millimeters Hg amounted to 284 grams (93.0 percent of theory). This polymer was used without further purification as a positive charge adjuvant in Liquid Toner 4 prepared in Example VII.

The reactivity ratios for MAGME™ and acrylonitrile in the American Cyanamid MAGME™ brochure 4-211-3K at 65° C. in toluene initiated with azobisvaleronitrile, a radical initiator very similar to the azobisisobutyrylnitrile radical initiator used in this work, were 0.66+ or −0.32 and 0.67+ or −0.24, respectively. These reactivity ratios predict that when acrylonitrile is the comonomer with MAGME™ there is no strong preference for either monomer to enter the growing polymer chain first and so a random copolymer should result. When the mole fraction of MAGME™ monomer in the comonomer mix with acrylonitrile is 20 mole percent, the reactivity ratios predict about 22 mole percent of MAGME™ to be present in the copolymer formed at low monomer conversion, and this close agreement between charged MAGME™ concentration and predicted MAGME™ repeat unit content in the random copolymer is maintained over the entire range (1 to 99 mole percent) of MAGME™ monomer charged.

EXAMPLE III

Positive Charge Adjuvant Preparation 3

Poly (Methyl Acrylamidoglycolate Methyl Ether) Homopolymer [SP2-123-27-1]:

To a 2 liter 3-neck round bottom flask were added 400 grams (2.31 mole) of methyl acrylamidoglycolate methyl ether (MAGME™) and 1,200 grams of methylethyl ketone solvent. The flask was equipped with a water condenser, an Argon inlet and an Argon outlet to a bubbler to ensure that a positive Argon flow was maintained in the reaction vessel throughout the polymerization period. The mixture was magnetically stirred and sparged with Argon at ambient temperature for 2 hours to dissolve the monomers and displace oxygen. To the resulting solution were added 4.00 grams (0.0165 mole) of benzoyl peroxide initiator, and the stirred solution was warmed to and maintained at reflux (80° C.) for 24 hours with a heating mantle. The polymer solution was cooled to ambient temperature and was then precipitated into 10 times its volume of hexane. The precipitated polymer was vacuum filtered and was then vacuum oven dried at 40° C. for 24 hours at about 1 millimeter Hg. The yield of precipitated polymer was 320 grams (80 percent of theory). This polymer was used without further purification as a positive charge adjuvant in Liquid Toner 2 prepared in Example V.

EXAMPLE IV

Liquid Toner Preparation 1

No Charge Adjuvant [26478-08]:

One hundred and eighty one (181.0) grams of NUCREL 599®, a copolymer of ethylene and methacrylic acid with a melt index at 190° C. of 500 rig/minute, available from E.I. DuPont de Nemours & Company, Wilmington, Del., 45.4 grams of the cyan pigment PV FAST BLUE™, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 86 to 96° C. for 2 hours and cooled by running water through the attritor jacket to 13° C. An additional 980.1 grams of NORPAR 15® were added, and ground in the attritor for an additional 4.5 hours. An additional 1,500 grams of NORPAR 15® were added and the mixture was separated by the use of a metal grate from the steel balls yielding a liquid toner concentrate of 7.29 percent solids wherein solids include resin, charge adjuvant, pigment and 92.71 percent of NORPAR 15®. The particle diameter was 1.90 microns average by area as measured with a Horiba Cappa 700. This toner concentrate was used to formulate liquid developer in Control 1A.

EXAMPLE V

Liquid Toner Preparation 2

5 Percent Poly (Methyl Acrylamidoglycolate Methyl Ether) as Charge Adjuvant 26711-24: From SP2-123-27-1]:

Eighteen and seventy five one-hundredths (18.75) grams of NUCREL 599®, a copolymer of ethylene and methacrylic acid with a melt index at 190° C. of 500 dg/minute, available from E.I. DuPont de Nemours & Company, Wilmington, Del., 5.0 grams of the cyan pigment PV FAST BLUE™, 1.25 grams of poly(methyl acrylamidoglycolate methyl ether) as prepared in Example III, and 142.0 grams of NORPAR 15®, carbon chain of 15 average, available from Exxon Corporation, were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket up to 96° C. at the beginning of the 2 hour hot stage time period and at the end of this time period the temperature was 50° C. The attritor was cooled by running cold water through the attritor jacket for 4 hours after which time the contents of the attritor dropped to 25° C. Additional NORPAR 15® was added to the attritor to rinse the toner particles off of the carbon steel balls, and the mixture was separated by the use of a metal grate from the steel balls yielding a liquid toner concentrate of 3.04 percent solids wherein solids include resin, charge adjuvant, pigment, and 96.96 percent of NORPAR 15®. The particle diameter was 1.76 microns average by area as measured with a Horiba Cappa 700. This toner concentrate was used to formulate liquid developer in Control 1B.

EXAMPLE VI

Liquid Toner Preparation 3

5 Percent Poly (Methyl Acrylamidoglycolate Methyl Ether-Co-Vinyl Acetate) as charge Adjuvant [26711-34 FROM SP2-115-66-1]:

Eighteen and seventy five one-hundredths (18.75) grams of NUCREL 599®, a copolymer of ethylene and methacrylic acid with a melt index at 190° C. of 500 dg/minute, available from E.I. DuPont de Nemours & Company, Wilmington, Del., 5.0 grams of the cyan pigment PV FAST BLUE™, 1.25 grams of a predominantly block copolymer poly(methyl acrylamidoglycolate methyl ether-co-vinyl acetate) as prepared in Example I, and 142.0 grams of NORPAR 15®, carbon chain of 15 average, available from Exxon Corporation, were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket up to 98° C. at the beginning of the 2 hour hot stage time period and at the end of this time period the temperature was 53° C. The attritor was cooled by running cold water through the attritor jacket for 4 hours after which time the contents of the attritor dropped to 23° C. Additional NORPAR 15® was added to the attritor to rinse the toner particles off of the carbon steel balls, and the mixture was separated by the use of a metal grate from the steel balls yielding a liquid toner concentrate of 2.91 percent solids wherein solids include resin, charge adjuvant, pigment, and 97.09 percent of NORPAR 15®. The particle diameter was 2.26 microns average by area as measured with a Horiba Cappa 700. This toner concentrate was selected to formulate liquid developer in Example XI.

EXAMPLE VII

Liquid Toner Preparation 4

5 Percent Poly (Methyl Acrylamidoglycolate Methyl Ether-Co-Acrylonitrile) as Charge Adjuvant [26711-31 FROM SP2-113-6-1]:

Eighteen and seventy five one-hundredths (18.75) grams of NUCREL 599®, a copolymer of ethylene and methacrylic acid with a melt index at 190° C. of 500 dg/minute, available from E.I. DuPont de Nemours & Company, Wilmington, Del., 5.0 grams of the cyan pigment PV FAST BLUE™, 1.25 grams of a random copolymer of poly(methyl acrylamidoglycolate methyl ether-co-acrylonitrile) as prepared in Example II, and 142.0 grams of NORPAR 15®, carbon chain of 15 average, available from Exxon Corporation, were added to a Union Process 01 attritor (Union Process Company, Akron, Ohio) charged with 0.1875 inch (4.76 millimeters) diameter carbon steel balls. The mixture was milled in the attritor which was heated with running steam through the attritor jacket up to 102° C. at the beginning of the 2 hour hot stage time period and at the end of this time period the temperature was 54° C. The attritor was cooled by running cold water through the attritor jacket for 4 hours after which time the contents of the attritor dropped to 22° C. Additional NORPAR 15® was added to the attritor to rinse the toner particles off of the carbon steel balls, and the mixture was separated by the use of a metal grate from the steel balls yielding a liquid toner concentrate of 2.90 percent solids wherein solids include resin, charge adjuvant, pigment, and 97.10 percent of NORPAR 15®. The particle diameter was 1.90 microns average by area as measured with a Horiba Cappa 700. This toner concentrate was selected to formulate liquid developer in Control 1C.

EXAMPLE VIII

Charge Director Preparation 1

Synthesis of Hydroxy Bis[3,5-Di-T-Butyl Salicylic] Alminate Monohydrate at Elevated Temperature To a solution of 12 grams (0.3 mole) sodium hydroxide in 500 milliliters of water were added 50 grams (0.2 mole) di-t-butyl salicylic acid. The resulting mixture was heated to 60° C. to dissolve the acid. A second solution was prepared from dissolving 33.37 grams (0.05 mole) of aluminum sulfate, $Al_2(SO_4)_3.18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis[3,5-tert-butyl salicylic] aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis[3,5-di-t-butyl salicylic] aluminate monohydrate was analyzed for water of hydration by Karl-Fischer titration after drying for an additional 24 hours at 100° C. in a vacuum, the sample contained 2.1 weight percent of water. The theoretical value calculated for a monohydrate is 3.2 weight percent of water.

The infrared spectrum of the above product hydroxy bis[3,5-di-tertiary-butyl salicylic] aluminate monohydrate indicated the absence of peaks characteristic of the starting material di-t-butyl salicylic acid and indicated the presence of a Al—OH band characteristic at 3,660 $cm^{-1}$ and peaks characteristic of water of hydration.

NMR analysis for the hydroxy aluminate complex was obtained for carbon, hydrogen and aluminum nuclei, and were all consistent with the above prepared monohydrate.

Elemental Analysis Calculated for $C_{30}H_{41}O_7Al$: C, 66.25; H, 7.62; Al, 5.52.

Calculated for $C_{30}H_{41}O_7Al.1H_2O$: C, 64.13; H, 7.74; Al, 4.81.

Found: C, 64.26; H, 8.11; Al, 4.67.

EXAMPLE IX

Charge Director Preparation 2

Synthesis of Hydroxy Bis[3,5 -Di-Tertiary-Butyl Salicylic] Aluminate Hydrate at Room Temperature The procedure of Charge Director Synthesis 1 was repeated with the exception that the mixing of the two solutions and subsequent stirring was accomplished at room temperature, about 25° C. The product was isolated and dried as in Charge Director Synthesis 1, and identified as the above hydroxy aluminum complex hydrate by infrared spectroscopy.

EXAMPLE X

Charge Director Preparation 3

PS-900/Hydroxy Bis[3,5 -Di-Tertiary-Butyl Salicylic] Aluminate Hydrate (1:1)

To a 500 milliliter Erlenmeyer flask were added 6.0 grams of hydroxy bis[3,5-di-tertiary-butyl salicylic] aluminate hydrate prepared in Example IX, 6.0 grams of EMPHOS PS-900® and 288 grams of NORPAR 15®. The mixture was magnetically stirred at ambient temperature for 8 hours giving a 4.0 weight percent charge director solution of 1:1 by weight of EMPHOS PS-900® and hydroxy bis[3,5-di-tertiary-butyl salicylic] aluminate hydrate. This charge director solution was used to charge all liquid toners in Controls 1A to 1C and Example XI at the same level (100 milligrams of charge director/gram of toner solids).

CONTROL 1

Cyan Liquid Developers Containing: (1A) No Positive Charge Adjuvant; (1B) Poly (Methylacrylamidoglycolate Methyl ether) Homopolymer Positive charge Adjuvant; (1C) Poly(Methylacrylamidoglycolate Methyl Ether-Co-Acrylonitrile) Random Copolymer Positive Charge Adjuvant:

Two hundred gram cyan liquid developer samples containing one percent toner solids were formulated as described in Table 1 below. In all Control 1 developers and in the Example XI developer that follows, the charge director level was constant at 100 milligrams of charge director/gram of toner solids (10 weight percent), and the developers were equilibrated for a constant time period of 4.5 months prior to measuring toner particle mobility and conductivity. Table 2 in Example XI describes the toner particle mobility and conductivity results as a function of poly(methyl acrylamidoglycolate methyl ether) positive charge adjuvant polymer type at a constant 5 weight percent polymer loading when the polymer was present as homopolymer, random copolymer, substantially block copolymer and when absent.

TABLE 1

CONTROL 1 CYAN LIQUID DEVELOPER FORMULATIONS

| Cyan Liquid Developer No. | Grams Toner Concentrate and Preparation Example No. | Grams Charge Director from Example X for 100 mg/g Level | Grams Norpar 15 Carrier Fluid | Positive Charge Adjuvant and Preparation Example No. |
|---|---|---|---|---|
| Control 1A | 27.43 Example IV | 5.00 | 167.57 | NONE |
| Control 1B | 65.79 Example V | 5.00 | 129.21 | 5%: Poly(methyl acrylamido-glycolate methyl ether) Homopolymer Example III |
| Control 1C | 68.97 Example VIII | 5.00 | 126.03 | 5%: Poly(methyl acrylamido-glycolate methyl ether-co-acrylonitrile) Random Copolymer Example II |

EXAMPLE XI

Cyan Liquid Developer Containing Poly(Methyl Acrylamidoglycolate Methyl Ether-Co-Vinyl Acetate) Positive Charge Adjuvant:

A 200 gram cyan liquid developer containing one percent toner solids was formulated by mixing 68.73 grams of the toner concentrate from Example VI with 5.00 grams of the 4 percent charge director solution from Example X and 126.27 grams of NORPAR 15® carrier fluid. The 5.00 grams of 4 percent charge director solution relative to the solid toner present are equivalent to 100 milligrams of charge director per gram of toner solids. After equilibrating for 4.5 months, the toner particle mobility and conductivity were measured and compared to the Control 1 developers equilibrated for the same time period. Inspection of Table 2 indicates that significant charging improvement was obtained with the developer containing poly(methyl acrylamidoglycolate methyl ether-co-vinyl acetate) as a positive charge adjuvant in the toner particles. Since this copolymer is largely a block copolymer because of solubility ratios favoring initial incorporation of the methyl acrylamidoglycolate methyl ether monomer into the growing polymer chain, it is believed that block copolymers containing methyl acrylamidoglycolate methyl ether blocks are more efficient methyl acrylamidoglycolate methyl ether containing positive charge adjuvant polymers, perhaps due to compatibility considerations between the non-methyl acrylamidoglycolate methyl ether block and the polymer resin. Thus, it is believed that the vinyl acetate block is more compatible with the polymer resin than is the acrylonitrile block, and that small quantities of poly(vinyl acetate)

homopolymer that may be present in the charge adjuvant composition are also compatibilized by the predominant block copolymer, thus maintaining toner resin compatibility.

TABLE 2

MOBILITY AND CONDUCTIVITY RESULTS FOR CONTROL 1 AND EXAMPLE XI CYAN LIQUID DEVELOPERS

| Cyan Liquid Developer No. | Zeta Potential (mV) | Conductivity pmho/cm | Comments |
|---|---|---|---|
| Control 1A | 199 | 5.7 | No positive charge adjuvant results in nominal charging |
| Control 1B | 189 | 6.4 | Poly(methy acrylamidoglycolate methyl ether) homopolymer gives only a marginal charging improvement |
| Control 1C | 203 | 6.1 | Poly(methyl acrylamidoglycolate methyl ether-co-acrylonitrile) random copolymer also gives only a marginal charging improvement |
| Example XI | 250 | 6.3 | Poly(methyl acrylamidoglycolate methyl ether-co-vinyl acetate) predominantly block copolymer gives a significant charging improvement |

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A positively charged liquid developer comprised of liquid, thermoplastic resin particles, optional pigment, a charge director, and an insoluble charge adjuvant comprised of a copolymer of an alkyl acrylamidoglycolate alkyl ether and an alkenylester, and which charge adjuvant is of the formula

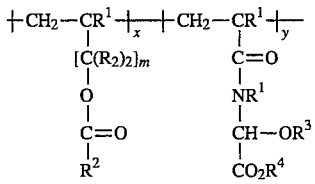

wherein $R^1$ is hydrogen or alkyl of 1 to 20 carbons; $R^2$ is H, alkyl of 1 to 20 carbons, aryl of 6 to 20 carbons, or aryl alkyl of 7 to 35 carbons; m is from 0 to about 10; $R^3$ and $R^4$ are alkyl; and x and y represent the number of segments, wherein for x and y 5.67>x/y>0.176.

2. A developer in accordance with claim 1 wherein the charge adjuvant is a copolymer of alkyl acrylamidoglycolate alkyl ether and vinyl acetate.

3. A developer in accordance with claim 1 wherein the charge adjuvant is a copolymer methylacrylamidoglycolate alkyl ether and vinyl acetate.

4. A developer in accordance with claim 1 wherein the charge adjuvant is a copolymer of methylacrylamidoglycolate alkyl ether and vinyl propionate.

5. A developer in accordance with claim 1 wherein alkyl contains 1 to 4 carbon atoms.

6. A developer in accordance with claim 1 wherein alkyl is methyl and aryl is phenyl.

7. A developer in accordance with claim 1 wherein the resin particles are comprised of a copolymer of ethylene and an α, β-ethytenically unsaturated acid selected from the group consisting of acrylic acid and methacrylic acid; or a copolymer of ethylene and methacrylic acid with a melt index at 190° C. of 500.

8. A developer in accordance with claim 1 wherein the pigment is present in an amount of about 0.1 to 60 percent by weight based on the total weight of the developer solids of resin, and pigment.

9. A developer in accordance with claim 8 wherein the pigment is carbon black.

10. A developer in accordance with claim 1 containing a colorant, pigment, or dye.

11. A developer in accordance with claim 1 wherein the charge adjuvant is present in an amount of from about 1 to about 100 weight percent based on the weight of the developer solids, and there is enabled a positively charged toner.

12. A developer in accordance with claim 1 wherein the liquid is an aliphatic hydrocarbon.

13. A developer in accordance with claim 12 wherein the aliphatic hydrocarbon is a mixture of branched hydrocarbons with from about 12 to about 20 carbons atoms, or wherein the aliphatic hydrocarbon is a mixture of normal hydrocarbons of from about 10 to about 20 carbon atoms.

14. A developer in accordance with claim 1 wherein $R^3$ and $R^4$ alkyl contain 1 to 4 carbon atoms.

15. A developer in accordance with claim 1 wherein R is alkyl of 1 to 6 carbon atoms, $R^2$ is alkyl of 1 to 10 carbon atoms, arylalkyl contains from 7 to about 26 carbon atoms, and $R^3$ and $R^4$ are independent alkyl of 1 to 4 carbon atoms.

16. A positively charged liquid electrostatographic developer comprised of (A) a liquid with a viscosity of from about 0.5 to about 20 centipoise and resistivity greater than or equal to about $5\times10^9$ ohm-cm; (B) thermoplastic resin particles with an average volume particle diameter of from about 0.1 to about 30 microns, and pigment; (C) insoluble charge adjuvant comprised of a copolymer of an alkyl acrylamidoglycolate alkyl ether and an alkenylester; and (D) a charge director.

17. A developer in accordance with claim 16 wherein the resin particles are comprised of a copolymer of ethylene and an α, β-ethylenically unsaturated acid selected from the group consisting of acrylic acid and methacrylic acid; or a copolymer of ethylene and methacrylic acid with a melt index at 190° C. of 500.

18. A developer in accordance with claim 16 wherein the pigment is black, cyan, magenta, yellow, or mixtures thereof.

19. A developer in accordance with claim 16 wherein component (A) is present in an amount of from about 85 percent to about 99.9 percent by weight, based on the total weight of the liquid developer, the total weight of developer solids is from about 0.1 percent to about 15 percent by weight, and component (D) is present in an amount of from about 5 to about 1,000 milligrams/gram developer solids.

20. A developer in accordance with claim 16 wherein component (C) is present in an amount of from about 0.1 to about 20 percent by weight of developer solids.

21. A developer in accordance with claim 16 further containing a second charge adjuvant selected from the group consisting of paratoluenesulfonic acid and polyphosphoric acid.

22. A developer in accordance with claim 16 wherein component (D) is a metal soap.

23. A developer in accordance with claim 16 wherein component (D) is an aluminum soap, or wherein (D) is a sodium salt of phosphated mono- and diglycerides with saturated and unsaturated substituents.

24. A developer in accordance with claim 16 wherein component (D) is an alkyl salicylic acid aluminum complex.

25. A developer in accordance with claim 16 wherein component (D) is a hydroxy bis(3,5-di-tert-butyl salicylic) aluminate monohydrate.

26. A developer in accordance with claim 16 wherein component (D) is comprised of a mixture hydroxy bis(3,5-di-tert-butyl salicylic) aluminate monohydrate, and an anionic complex organic phosphate ester.

27. An imaging method which comprises forming an electrostatic latent image followed by the development thereof with a positively charged liquid developer comprised of liquid, thermoplastic resin particles, optional pigment, a charge director, and an insoluble charge adjuvant comprised of a copolymer of an alkyl acrylamidoglycolate alkyl ether and an alkenylester, and which charge adjuvant is of the formula

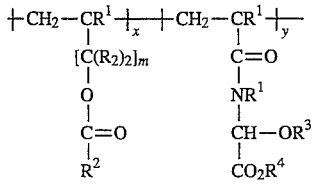

wherein $R^1$ is hydrogen or alkyl of 1 to 20 carbons; $R^2$ is H, alkyl of 1 to 20 carbons, aryl of 6 to 20 carbons, or aryl alkyl of 7 to 35 carbons; m is from 0 to about 10; $R^3$ and $R^4$ are alkyl; and x and y represent the number of segments, wherein for x and y $5.67>x/y>0.176$.

* * * * *